US011035265B2

(12) United States Patent
Ni

(10) Patent No.: US 11,035,265 B2
(45) Date of Patent: Jun. 15, 2021

(54) METHODS AND SYSTEM FOR AN ENGINE LUBRICATION SYSTEM WITH A THREE-STAGE OIL COOLER BYPASS VALVE

(71) Applicant: Ford Global Technologies, LLC, Dearborn, MI (US)

(72) Inventor: Ben Xuehai Ni, Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 16/563,697

(22) Filed: Sep. 6, 2019

(65) Prior Publication Data

US 2021/0071551 A1 Mar. 11, 2021

(51) Int. Cl.

| | |
|---|---|
| ***F01M 5/00*** | (2006.01) |
| ***F01M 1/16*** | (2006.01) |
| ***F01P 11/08*** | (2006.01) |
| ***F01M 1/02*** | (2006.01) |
| ***F01P 7/16*** | (2006.01) |
| *F01P 3/00* | (2006.01) |

(52) U.S. Cl.

CPC ..... *F01M 5/005* (2013.01); *F01M 1/02* (2013.01); *F01M 1/16* (2013.01); *F01P 7/161* (2013.01); *F01P 11/08* (2013.01); *F01P 2003/006* (2013.01)

(58) Field of Classification Search

CPC ..... F01M 5/005; F01M 1/02; F01M 1/16; F01M 7/161; F01M 11/08; F01M 2003/006

See application file for complete search history.

(56) References Cited

U.S. PATENT DOCUMENTS 3,090,365 A * 5/1963 Constantino ..... F01P 7/14 123/41.08
3,913,831 A * 10/1975 Talak ..... F01M 5/007 236/34.5
4,245,465 A * 1/1981 Milo ..... F16N 27/00 184/6.11
4,276,960 A * 7/1981 Webb ..... F04C 29/0014 137/115.14
4,776,838 A 10/1988 Sainte-Rose et al.
9,896,979 B2 2/2018 Noonchester et al.

(Continued)

FOREIGN PATENT DOCUMENTS

AU 719036 B2 4/1997
CA 2452309 A1 6/2005

*Primary Examiner* — Syed O Hasan

(74) *Attorney, Agent, or Firm* — Geoffrey Brumbaugh; McCoy Russell LLP

(57) ABSTRACT

Methods and systems are provided for controlling a temperature of an oil used for lubricating an engine of a vehicle. In one example, a method comprises controlling an oil pump to pump oil at a first pressure, a second pressure or a third pressure in order to bias an oil cooler bypass valve to a first position, a second position or a third position, respectively, as a function of engine operating conditions. In this way, oil may be selectively routed through or around the oil cooler depending on engine operating conditions, which may serve to control oil temperature in line with the operating conditions and additionally improve fuel economy by reducing a load on the oil pump when operating conditions are such that the oil pump can be bypassed.

20 Claims, 6 Drawing Sheets

(56) References Cited

U.S. PATENT DOCUMENTS

| | | | | |
|---|---|---|---|---|
| 2012/0211216 | A1 | 8/2012 | Noonchester et al. | |
| 2015/0300218 | A1* | 10/2015 | Taguchi | F01M 1/08 123/196 CP |
| 2018/0372210 | A1* | 12/2018 | Poster | B64C 27/14 |

* cited by examiner

300

METHODS AND SYSTEM FOR AN ENGINE LUBRICATION SYSTEM WITH A THREE-STAGE OIL COOLER BYPASS VALVE

FIELD

The present description relates generally to methods and systems for controlling a flow of oil through or around an oil cooler by way of a three-stage oil cooler bypass valve as a function of oil pressure from an oil pump.

BACKGROUND/SUMMARY

A vehicle engine includes a multitude of moving parts. For example, pistons inside engine cylinders move in an upward and downward fashion corresponding to different strokes of the engine. Accordingly, it is imperative that engine systems be properly lubricated to prevent undesirable noise, vibration and harshness (NVH), and for purposes of reducing engine degradation.

An engine lubrication system may include a sump filled with engine oil and an oil pump that may draw oil from the sump. Oil drawn from the sump may be drawn through a strainer, and may then be directed through an oil filter to engine main bearings and an oil pressure gauge. From the main bearings, the oil passes into drilled passages in a crankshaft and big-end bearings of a connecting rod. Oil fling dispersed by the rotating crankshaft may lubricate engine cylinder walls and pinto-pin bearings. Excess oil may be scraped off by scraper rings on a piston. Engine oil may also lubricate camshaft bearings and the timing chain or gears on the camshaft drive. Excess engine oil in the system then drains back to the sump.

In some examples, a heat exchanger (also referred to herein as an oil cooler) may be positioned between the oil pump and the oil filter. The engine oil cooler may be configured to cool or heat engine oil during engine operation. For example, an oil cooler may enable a more even temperature throughout the engine, which may reduce chances of engine degradation, may increase engine power, and may improve fuel economy.

However, there are certain vehicle operating conditions where it may be desirable to bypass the engine oil cooler. Towards this end, U.S. Pat. No. 9,896,979 discloses a system for controlling a temperature of oil in an engine, where the system includes a heat exchanger configured to receive oil from the engine, modify temperature of the oil, and return the modified temperature oil to the engine. The system includes a valve configured to direct the oil through the heat-exchanger during a warm-up operation of the engine such that the oil temperature is increased. The valve is configured to direct the oil to bypass the heat-exchanger during a low-load operation of the engine such that the temperature of the oil is increased. Furthermore, the valve is configured to direct the oil through the heat-exchanger during a high load operation of the engine such that the temperature of the oil is decreased.

However, the inventors herein have recognized potential issues with such a system. Specifically, the valve operates based on an oil pressure differential that is a function of oil viscosity, temperature, and flow rate, and thus it may be challenging to develop a spring for the valve that responds as desired under a wide range of oil viscosity, temperature and flow rates. Furthermore, the valve includes an additional actuator (e.g. wax thermostat or electro-magnetic solenoid valve) for directing oil to bypass the heat exchanger under high load conditions.

Thus, the inventors herein have developed systems and methods to at least partially address the above-mentioned issues. In one example, a method comprises controlling an oil pump to pump an oil for lubricating an engine at a first pressure, a second pressure or a third pressure to bias an oil cooler bypass valve to a first position, a second position or a third position, respectively, as a function of engine operating conditions, to selectively route the oil through or around an oil cooler. In this way, a controller of a vehicle may command a variable flow oil pump to pump oil at varying pressures in line with particular engine operation conditions, and the bypass valve will passively adjust to the varying pressures to control whether the oil bypasses the oil cooler or is routed through the oil cooler. Such methodology may improve fuel economy by reducing a load on the oil pump when operating conditions are such that oil cooler can be bypassed.

In a first example of the method, the first position is a first open position where the oil is routed around the oil cooler, the second position is a closed position where oil is prevented from being routed around the oil cooler, and the third position is a second open position where the oil is routed around the oil cooler. The first pressure may be greater than the second pressure, and the second pressure may in turn be greater than the third pressure. For example, the first pressure may be greater than 500 kPa, the second pressure may be between 250 and 400 kPa, and the third pressure may be between 100-200 kPa.

As another example, the method may include biasing the oil cooler bypass valve to the first position at a cold-start event of the engine where a temperature of the oil is greater than a threshold below a predetermined oil temperature and where a circuit that receives the oil is below a predetermined circuit pressure. The method may include biasing the oil cooler bypass valve to the second position to control the temperature of the oil to within the threshold of the predetermined oil temperature. The method may still further include biasing the oil cooler bypass valve to the third position when the temperature of the oil is within the threshold of the predetermined oil temperature.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
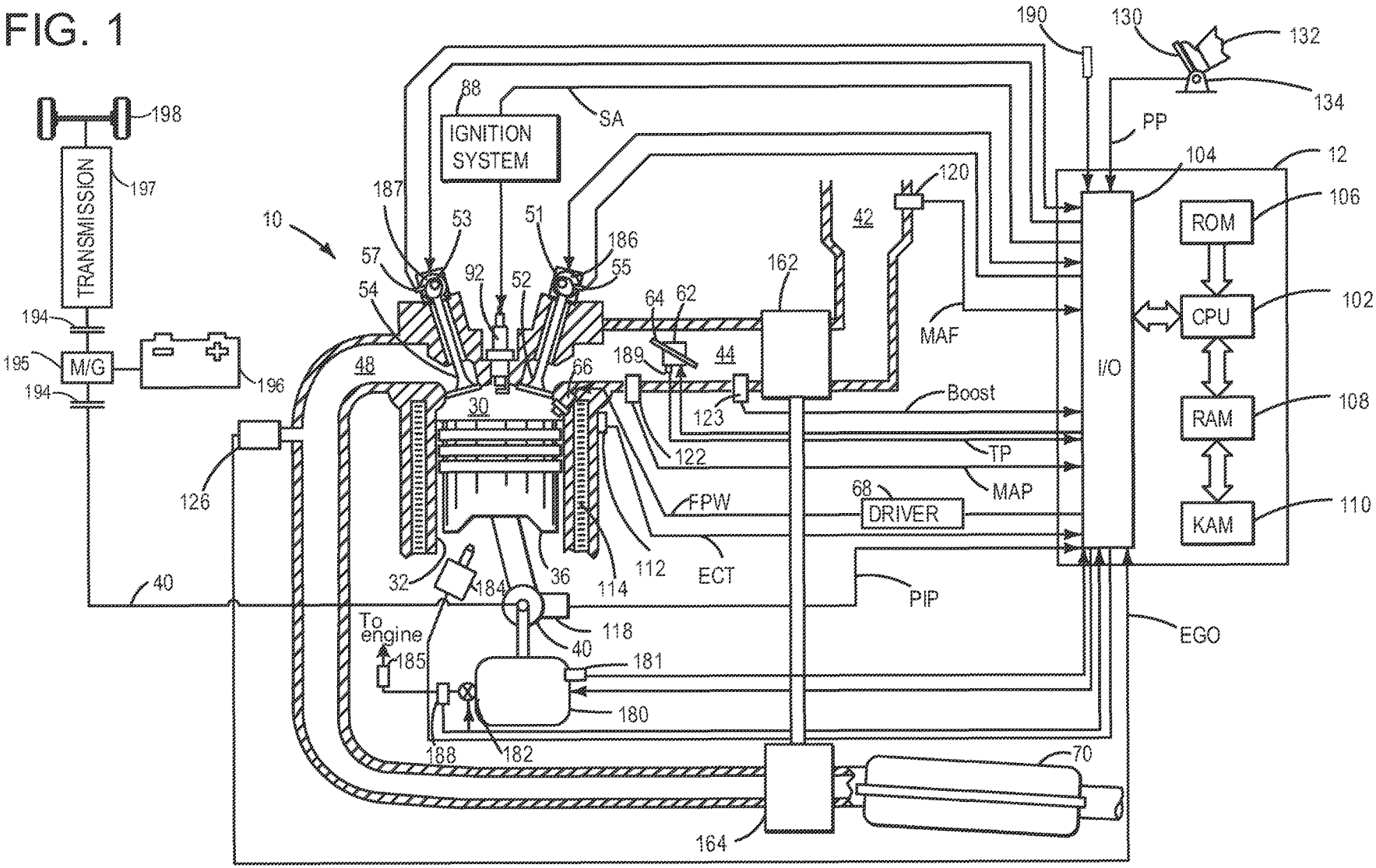
FIG. 1 is a schematic diagram of an engine.
Figure 2:
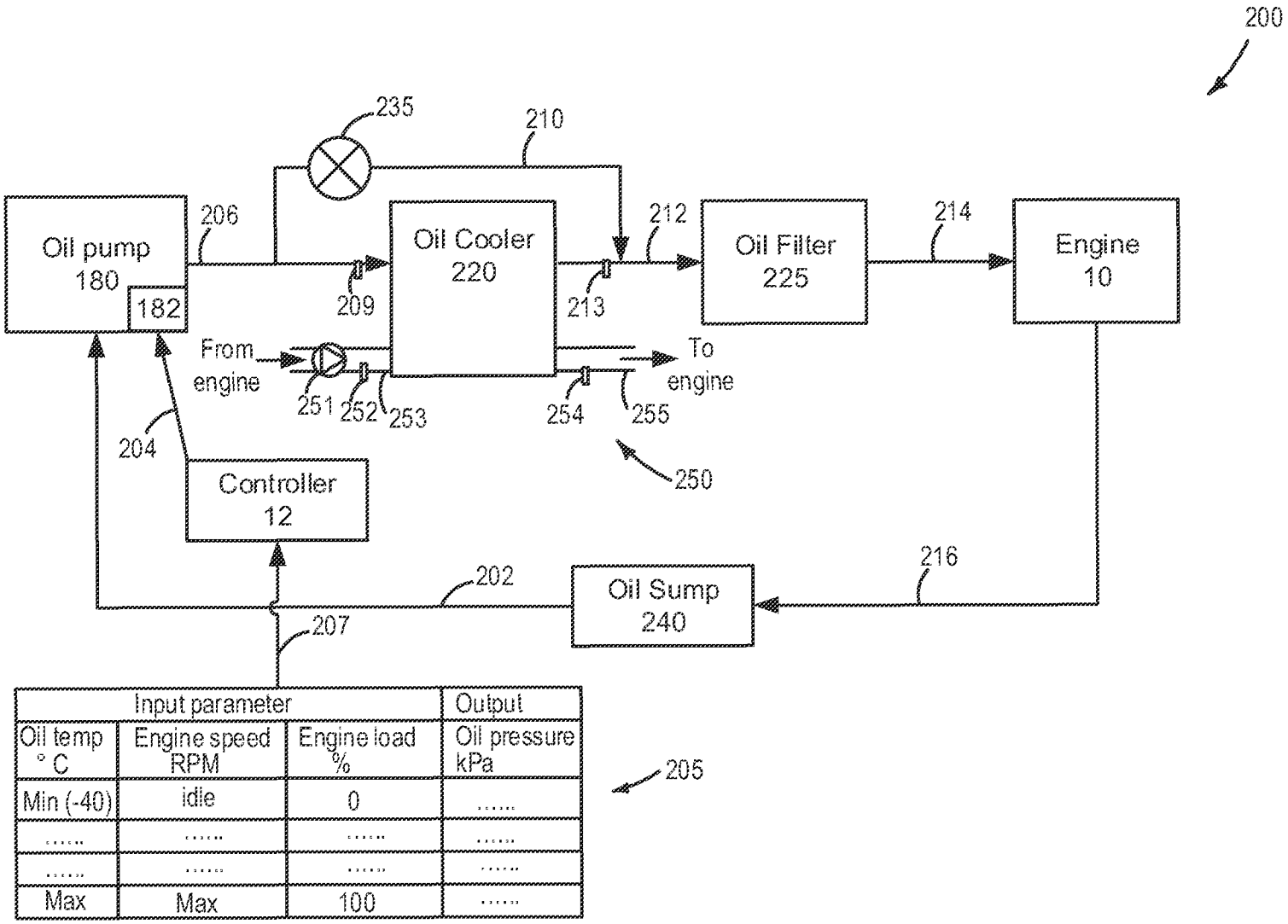
FIG. 2 is a schematic illustration of an engine lubrication system.
Figure 3A:
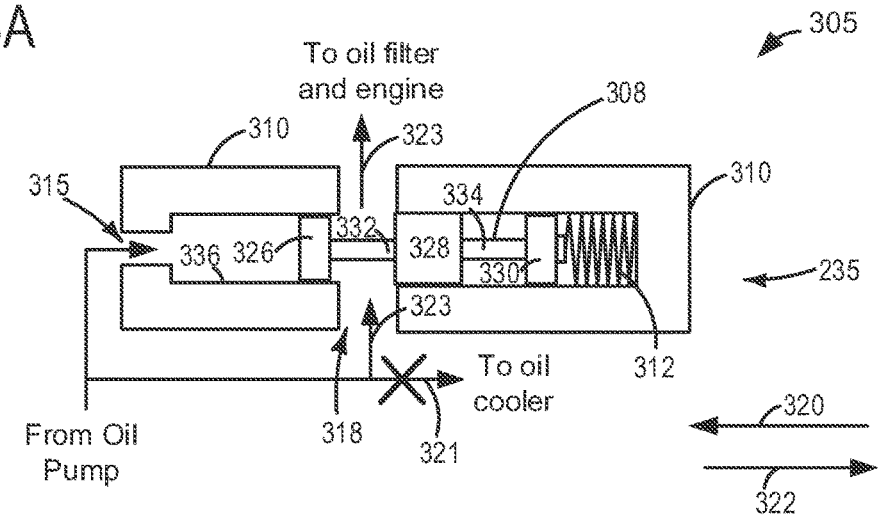
FIGS. 3A-3C depict different states that an oil cooler bypass valve of the present disclosure can adopt.
Figure 3B:
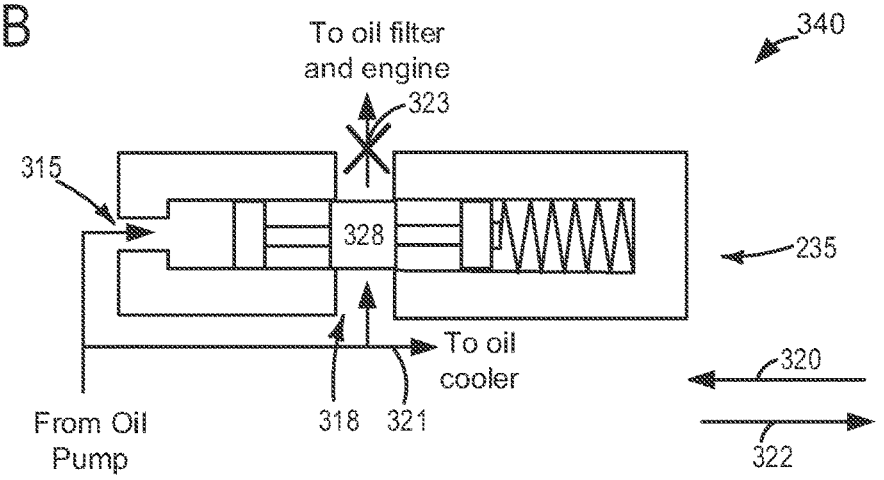
Figure 3C:
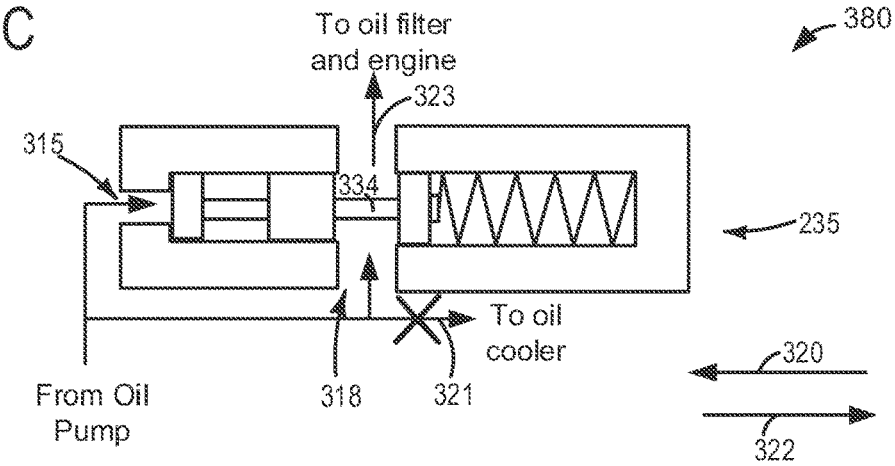
Figure 4:
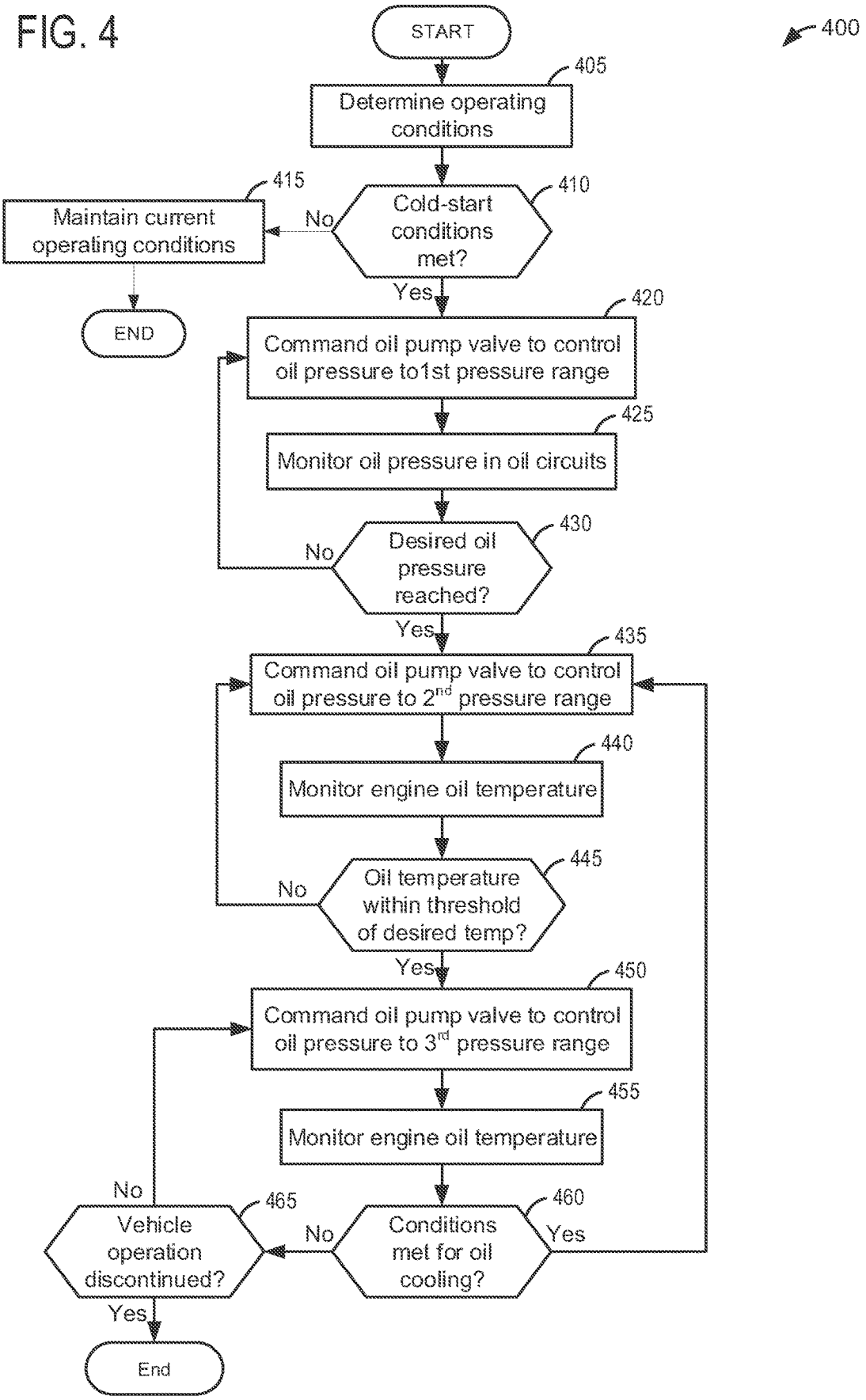
FIG. 4 describes an example method for controlling a flow of engine oil under varying vehicle operating conditions.
Figure 5:
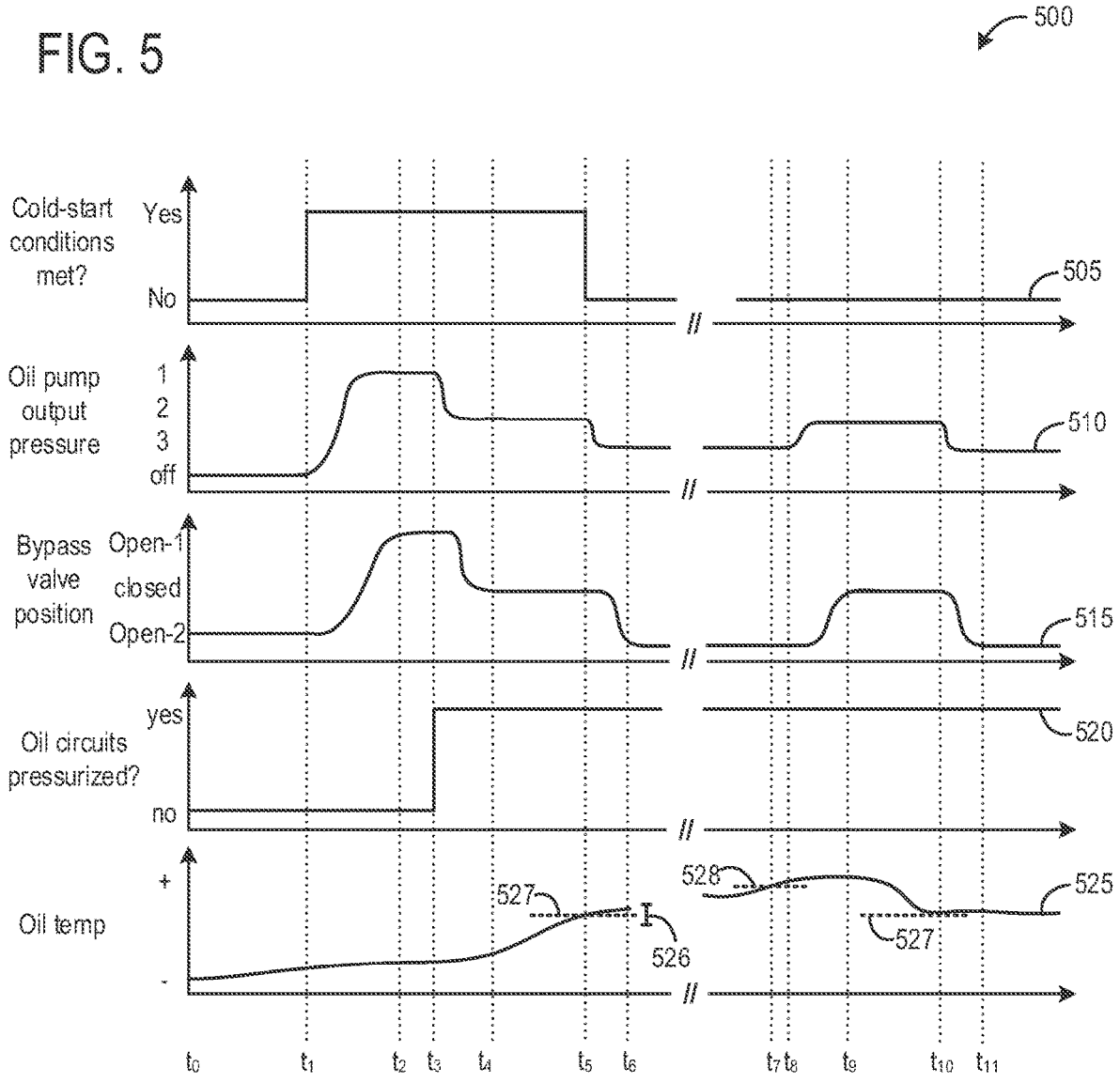
FIG. 5 depicts a prophetic example for controlling oil pump output pressure in order to bias an oil cooler bypass valve to desired positions as a function of vehicle operating conditions.
Figure 6:
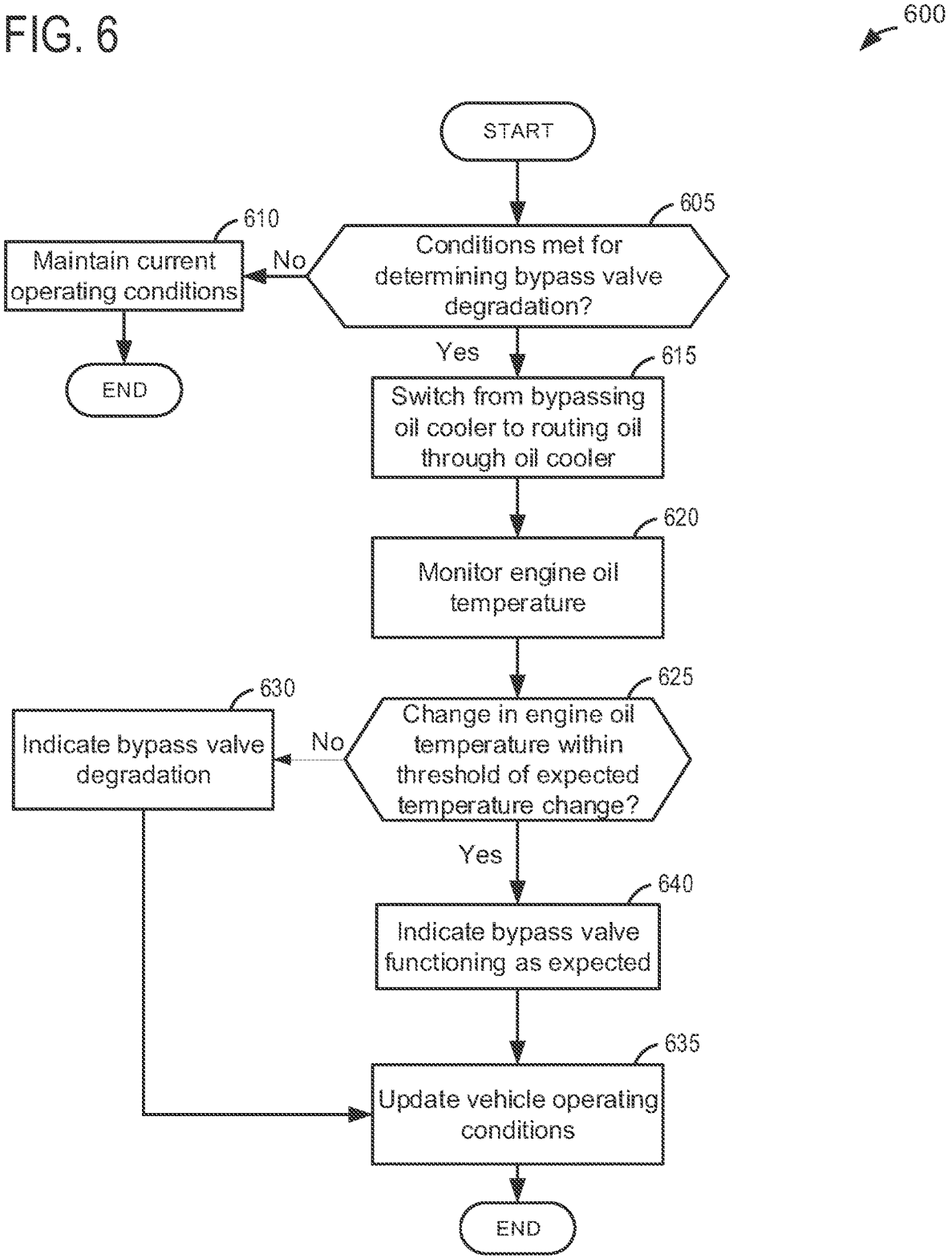
FIG. 6 depicts an example method for determining whether the bypass valve of FIGS. 3A-3C is degraded or is functioning as expected.

The following description relates to systems and methods for controlling an engine lubrication system that includes a passively actuatable bypass valve that regulates a flow of engine oil through or around an oil cooler. Specifically, the bypass valve may respond to changes in oil pressure output from an oil pump for which oil pressure output can be actively controlled. Accordingly, FIG. 1 depicts an engine coupled to an oil pump, and FIG. 2 shows an example lubrication system of the present disclosure that includes the oil pump, engine, oil cooler and passively actuatable oil cooler bypass valve. FIGS. 3A-3C depict how oil pressure may act on the bypass valve to bias the bypass valve to different configurations. A method for controlling oil pump output pressure as a function of vehicle operating conditions to selectively route oil around the oil cooler or through the oil cooler is shown at FIG. 4. A prophetic example of how the oil pump may be controlled (thereby regulating flow of the oil through or around the oil cooler) based on varying vehicle operating conditions is depicted at FIG. 5. An example diagnostic method for determining whether the bypass valve is degraded or is functioning as expected, is depicted at FIG. 6.

FIG. 1 is a schematic diagram showing one cylinder of multi-cylinder engine 10, which may be included in a propulsion system of an automobile. Engine 10 may be controlled at least partially by a control system including controller 12 and by input from a vehicle operator 132 via an input device 130. In this example, input device 130 includes an accelerator pedal and a pedal position sensor 134 for generating a proportional pedal position signal PP. Combustion chamber (i.e., cylinder) 30 of engine 10 may include combustion chamber walls 32 with piston 36 positioned therein. Piston 36 may be coupled to crankshaft 40 so that reciprocating motion of the piston is translated into rotational motion of the crankshaft. Crankshaft 40 may be coupled to at least one drive wheel of a vehicle via an intermediate transmission system. Further, a starter motor may be coupled to crankshaft 40 via a flywheel to enable a starting operation of engine 10.

Combustion chamber 30 may receive intake air from intake manifold 44 via intake passage 42 and may exhaust combustion gases via exhaust passage 48. Intake manifold 44 and exhaust passage 48 can selectively communicate with combustion chamber 30 via respective intake valve 52 and exhaust valve 54. In some embodiments, combustion chamber 30 may include two or more intake valves and/or two or more exhaust valves.

In this example, intake valve 52 and exhaust valves 54 may be controlled by cam actuation via respective cam actuation systems 51 and 53. Cam actuation systems 51 and 53 may each include one or more cams and may utilize one or more of cam profile switching (CPS), variable cam timing (VCT), variable valve timing (VVT) and/or variable valve lift (VVL) systems that may be operated by controller 12 to vary valve operation. For example, valve operation may be varied as part of pre-ignition abatement or engine knock abatement operations. The position of intake valve 52 and exhaust valve 54 may be determined by position sensors 55 and 57, respectively. In alternative embodiments, intake valve 52 and/or exhaust valve 54 may be controlled by electric valve actuation. For example, cylinder 30 may alternatively include an intake valve controlled via electric valve actuation and an exhaust valve controlled via cam actuation including CPS and/or VCT systems.

In one example, cam actuation systems 51 and 53 are variable cam timing systems that include cam phasers 186 and 187 that are hydraulically actuated via oil from a variable flow oil pump 180. Variable flow oil pump may also be referred to herein as variable displacement oil pump 180. Under some conditions, an output flow rate of variable flow oil pump 180 may be varied to control a response time for cam phasers 186 and 187 to change a position of the cams based on operating conditions. For example, under high engine loads, the output flow rate of the variable flow oil pump 180 may be increased, so that the cam phasers 186 and 187 change position more quickly and correspondingly change a position of the cams more quickly than under low engine loads.

Engine 10 may further include a compression device such as a turbocharger or supercharger including at least a compressor 162 arranged along intake manifold 44. For a turbocharger, compressor 162 may be at least partially driven by a turbine 164 (e.g. via a shaft) arranged along exhaust passage 48. For a supercharger, compressor 162 may be at least partially driven by the engine and/or an electric machine, and may not include a turbine. Thus, the amount of compression provided to one or more cylinders of the engine via a turbocharger or supercharger may be varied by controller 12. A boost sensor 123 may be positioned downstream of the compressor in intake manifold 44 to provide a boost pressure (Boost) signal to controller 12.

Fuel injector 66 is shown coupled directly to combustion chamber 30 for injecting fuel directly therein in proportion to the pulse width of signal FPW received from controller 12 via electronic driver 68. In this manner, fuel injector 66 provides what is known as direct injection of fuel into combustion chamber 30. The fuel injector may be mounted in the side of the combustion chamber or in the top of the combustion chamber, for example. Fuel may be delivered to fuel injector 66 by a fuel system (not shown) including a fuel tank, a fuel pump, and a fuel rail. In some embodiments, combustion chamber 30 may alternatively or additionally include a fuel injector arranged in intake manifold 44 in a configuration that provides what is known as port injection of fuel into the intake port upstream of combustion chamber 30. Fuel injector 66 may be controlled to vary fuel injection in different cylinder according operating conditions. For example, controller 12 may command fuel injection to be stopped in one or more cylinders as part of pre-ignition abatement operations so that combustion chamber 30 is allowed to cool. Further, intake valve 52 and/or exhaust valve 53 may be opened in conjunction with the stoppage of fuel injection to provide intake air for additional cooling.

Intake passage 42 may include a throttle 62 having a throttle plate 64. In this particular example, the position of throttle plate 64 may be varied by controller 12 via a signal provided to an electric motor or actuator included with throttle 62, a configuration that is commonly referred to as electronic throttle control (ETC). In this manner, throttle 62 may be operated to vary the intake air provided to combustion chamber 30 among other engine cylinders. The position of throttle plate 64 may be provided to controller 12 by throttle position signal TP. Intake passage 42 may include a mass air flow sensor 120 and a manifold air pressure sensor 122 for providing respective signals MAF and MAP to controller 12.

Ignition system 88 can provide an ignition spark to combustion chamber 30 via spark plug 92 in response to spark advance signal SA from controller 12, under select operating modes. Controller 12 may vary signal SA based on operating conditions. For example, controller may retard signal SA in order to retard spark in response to an indication of engine knock as part of engine knock abatement operations. Though spark ignition components are shown, in some embodiments, combustion chamber 30 or one or more other combustion chambers of engine 10 may be operated in a compression ignition mode, with or without an ignition spark.

Variable flow oil pump 180 can be coupled to crankshaft 40 to provide rotary power to operate the variable flow oil pump 180. In one example, the variable flow oil pump 180 includes a plurality of internal rotors (not shown) that are eccentrically mounted. At least one of the internal rotors can be controlled by controller 12 to change the position of that rotor relative to one or more other rotors to adjust an output flow rate of the variable flow oil pump 180 and thereby adjust the oil pressure. For example, the electronically controlled rotor may be coupled to a rack and pinion assembly that is adjusted via the controller 12 to change the position of the rotor. The variable flow oil pump 180 may selectively provide oil to various regions and/or components of engine 10 to provide cooling and lubrication. The output flow rate or oil pressure of the variable flow oil pump 180 can be adjusted by the controller 12 to accommodate varying operating conditions to provide varying levels of cooling and/or lubrication. Further, the oil pressure output from the variable flow oil pump 180 may be adjusted to reduce oil consumption and/or reduce energy consumption by the variable flow oil pump 180.

It will be appreciated that any suitable variable flow oil pump configuration may be implemented to vary the oil pressure and/or oil output flow rate. In some embodiments, instead of being coupled to the crankshaft 40 the variable flow oil pump 180 may be coupled to a camshaft, or may be powered by a different power source, such as a motor or the like. Furthermore, in some examples, the variable flow oil pump may be a vane-type pump where pressure output is regulated via a solenoid valve, as will be discussed in further detail below.

Engine oil users 185 may receive oil from variable flow oil pump 180. Discussed herein, engine oil users 185 may include any and all locations or galleries in an engine system that receive oil. As an example, oil injector 184 may be coupled downstream of an output of the variable flow oil pump 180 to selectively receive oil from the variable flow oil pump 180. In some additional or alternative embodiments, the oil injector 184 may be omitted, or it may be incorporated into the combustion chamber walls 32 of the engine cylinder and may receive oil from galleries formed in the walls. The oil injector 184 may be operable to inject oil from the variable flow oil pump 180 onto an underside of piston 36. The oil injected by oil injector 184 may provide cooling effects to the piston 36. Furthermore, through reciprocation of piston 36, oil may be drawn up into combustion chamber 30 to provide cooling effects to walls of the combustion chamber 30. Moreover, oil injector 184 may provide oil for lubrication of an interface between piston 36 and combustion chamber 30.

An oil pump valve 182 may be positioned between the output of the variable flow oil pump 180 and the oil injector 184 to control flow of oil to the oil injector 184 and other oil users (e.g. oil users 185). In some examples, oil pump valve 182 may be used to regulate a pressure of oil that flows to oil injector 184 and oil users 185. As one such example, when the oil pump valve 182 is commanded fully closed, a greater output pressure from variable flow oil pump 180 may be communicated to oil injector 184 and oil users 185 as compared to when the valve is fully open. Thus, in such an example, when the valve is closed pump displacement may be increased as compared to when the valve is opened. Alternatively, in another embodiment, the output pressure from the variable flow oil pump 180 may increase under circumstances where oil pump valve 182 is in a fully open position as compared to a fully closed positon. In such an example, when the valve is commanded fully open, pump displacement may be increased as compared to when oil pump valve 182 is commanded to a fully closed position. In other words, depending on the type of pump, the oil pump valve may be differentially controlled so as to exert control over pressure of oil emanating from variable flow oil pump 180. In some embodiments, the oil pump valve 182 may be an electronically actuatable valve (e.g. solenoid valve) that is controlled by controller 12. As one example, the oil pump valve is a proportional solenoid valve that may vary a flow of oil from the pump by adjusting a size of a restriction that the oil passes through. While not explicitly illustrated at FIG. 1, it may be understood that there may be an oil cooler, an oil filter and an engine cooler bypass valve positioned between the output of the variable flow oil pump 180 and the oil injector 184. Such components will be discussed in further detail below with regard to FIGS. 2 and 3A-3C.

Oil pump valve 182 may have a default pressure regulation set point under conditions where the solenoid valve is de-energized. In other words, when the oil pump valve is de-energized, for example, oil pressure may be regulated to the default pressure regulation set point. This default pressure may be higher than a maximum oil pressure requirement of the engine at all conditions, for example. In other examples, the opposite may be true, for example when the oil pump valve is energized, oil pressure may be regulated to the default pressure regulation set point, depending on the type of pump associated with oil pump valve 182 and how pressure output is controlled for such a valve. It may be understood that the controller 12 may send an electric signal to the oil pump valve (e.g. solenoid valve) in order to control the oil pressure to a target pressure anywhere between the default high pressure regulation set point and a minimum value limited by the oil pump. The target pressure may depend on one or more of engine load and/or engine speed, oil temperature, engine temperature, coolant temperature, ambient temperature, etc. Desired oil pressure may be lower at mild engine conditions, and may be higher at higher load and speed conditions.

Exhaust gas sensor 126 is shown coupled to exhaust passage 48 upstream of emission control device 70. Sensor 126 may be any suitable sensor for providing an indication of exhaust gas air-fuel ratio such as a linear oxygen sensor or UEGO (universal or wide-range exhaust gas oxygen), a two-state oxygen sensor or EGO, a HEGO (heated EGO), a NOx, HC, or CO sensor. Emission control device 70 is shown arranged along exhaust passage 48 downstream of exhaust gas sensor 126. Device 70 may be a three way catalyst (TWC), NOx trap, various other emission control devices, or combinations thereof. In some embodiments, during operation of engine 10, emission control device 70 may be periodically reset by operating at least one cylinder of the engine within a particular air-fuel ratio.

Controller 12 is shown in FIG. 1 as a microcomputer, including microprocessor unit 102, input/output ports 104, an electronic storage medium for executable programs and calibration values shown as read only memory chip 106 in this particular example, random access memory 108, keep alive memory 110, and a data bus. Controller 12 may receive various signals from sensors coupled to engine 10, in addition to those signals previously discussed, including measurement of inducted mass air flow (MAF) from mass air flow sensor 120; a profile ignition pickup signal (PIP) from Hall effect sensor 118 (or other type) coupled to crankshaft 40; throttle position (TP) from throttle position sensor 189; and absolute manifold pressure signal, MAP, from sensor 122. Engine speed signal, RPM, may be generated by controller 12 from signal PIP. Manifold pressure signal MAP from a manifold pressure sensor may be used to provide an indication of vacuum, or pressure, in the intake manifold. Note that various combinations of the above sensors may be used, such as a MAF sensor without a MAP sensor, or vice versa. During stoichiometric operation, the MAP sensor can give an indication of engine torque. Further, this sensor, along with the detected engine speed, can provide an estimate of charge (including air) inducted into the cylinder. In one example, sensor 118, which is also used as an engine speed sensor, may produce a predetermined number of equally spaced pulses every revolution of the crankshaft. Moreover, these sensors may be used to derive an indication of engine load.

Furthermore, controller 12 may receive signals that may be indicative of various temperatures related to the engine 10. For example, engine coolant temperature (ECT) from temperature sensor 112 coupled to cooling sleeve 114 may be sent to controller 12. In some embodiments, sensor 126 may provide an indication of exhaust temperature to controller 12. Sensor 181 may provide an indication of oil temperature and/or oil viscosity to controller 12. One or more of these sensors may provide an indication of an engine temperature that may be used by controller 12 to control operation of the oil injector 184. Controller 12 may receive signals indicative of an ambient temperature from sensor 190.

Further, controller 12 may receive an indication of oil pressure from pressure sensor 188 positioned downstream of an output of variable flow oil pump 180. The oil pressure indication may be used by the controller 12 to control adjustment of oil pressure by varying an output flow rate of variable flow oil pump 180.

Oil pressure and oil flow rates output by variable flow oil pump 180 may in some examples be functions of engine oil viscosity. Engine oil viscosity may be based on engine oil temperature and an engine oil viscosity index. The engine oil viscosity index may be different for different engine oil formulas, and may change over time as engine oil is used within an internal combustion engine.

In some examples, engine 10 may be included in a hybrid electric vehicle (HEV) or plug-in HEV (PHEV), with multiple sources of torque available to one or more vehicle wheels 198. In the example shown, vehicle system 100 may include an electric machine 195. Electric machine 195 may be a motor or a motor/generator. Crankshaft 40 of engine 10 and electric machine 195 are connected via a transmission 197 to vehicle wheels 198 when one or more clutches 194 are engaged. In the depicted example, a first clutch is provided between crankshaft 199 and electric machine 195, and a second clutch is provided between electric machine 195 and transmission 197. Controller 12 may send a signal to an actuator of each clutch 194 to engage or disengage the clutch, so as to connect or disconnect crankshaft 40 from electric machine 195 and the components connected thereto, and/or connect or disconnect electric machine 195 from transmission 197 and the components connected thereto. Transmission 197 may be a gearbox, a planetary gear system, or another type of transmission. The powertrain may be configured in various manners including as a parallel, a series, or a series-parallel hybrid vehicle.

Electric machine 195 may receive electrical power from a traction battery 196 to provide torque to vehicle wheels 198. Electric machine 195 may also be operated as a generator to provide electrical power to charge traction battery 196, for example during a braking operation.

Turning now to FIG. 2, an example engine lubrication system 200 is depicted. Engine lubrication system 200 includes engine 10, controller 12, oil pump 180, and oil pump valve 182 as discussed above with regard to FIG. 1 above. Engine lubrication system 200 further includes oil cooler 220, oil filter 225, and oil sump 240. Also depicted is coolant system 250. Heat energy generated by engine operation may be reduced via circulating heat transfer fluid or coolant (not shown) through the engine and other coolant conduits via a fluid or coolant pump 251. Coolant may be a solution of a suitable organic chemical (e.g. ethylene glycol, diethylene glycol, or propylene glycol) in water. Coolant may be routed to oil cooler 220 along first coolant conduit 253, and may exit oil cooler 220 via second coolant conduit 255. First coolant conduit 253 may include a first temperature sensor 252 and second coolant conduit may include a second temperature sensor 254. Thus, it may be understood that oil cooler 220 may operate as a coolant-to-oil radiator. Oil cooler 220 may transfer heat energy between the coolant and the oil, depending on relative temperatures of each of the coolant and the oil. For example, when oil temperature is greater than that of the coolant, the oil cooler may enable the coolant to absorb heat energy from the oil to thus cool the oil. Alternatively, when coolant temperature is greater than that of the oil, the oil cooler may enable the coolant to transfer heat energy to the oil, to thereby raise the temperature of the oil. Thus, the coolant pump 251 may be configured to circulate coolant through oil cooler 220 in order to modify the temperature of the oil.

A flow of oil via engine lubrication system 200 will now be discussed. Oil sump 240 houses oil for engine lubrication system 200. Oil pump 180 draws oil from oil sump 240 as depicted via arrow 202. Output of the pump and/or the oil pressure may be under control of controller 12 through oil pump valve 182, as discussed above and as depicted via arrow 204. Controller 12 may determine output instructions based on querying lookup table 205, as depicted via arrow 207. Lookup table 205 may include input parameters and output parameters. Input parameters may include but are not limited to temperature of the oil, engine speed (RPM) and engine load. The output parameter may correspond to oil pressure (e.g. kPa). Oil temperature may range from a minimum (e.g. −40° C.) to a maximum (unspecified value), engine speed may range from a minimum (e.g. idle speed) to a maximum (unspecified value), and engine load may range from a minimum (e.g. 0%) to a maximum (e.g. 100%). While specific values are not shown for oil pressure output, it may be understood that individual values may be retrieved as a function of one or more variables including but not limited to oil temperature, engine speed and engine load.

Output from oil pump 180 may be regulated via oil pump valve 182, under control of controller 12. As an example, a pulse-width modulation (PWM) signal sent to oil pump valve 182 may be controlled so as to achieve the desired output oil pressure as retrieved from lookup table 205.

Output from oil pump 180 may be directed to a first conduit (represented by arrow 206) that fluidically couples oil pump 180 and oil cooler 220. A second conduit (represented by arrow 210) may stem from the first conduit, and may include an oil cooler bypass valve 235. Bypass valve 235 may comprise a passively actuatable valve, as will be discussed in greater detail with regard to FIGS. 3A-3C. Under conditions where bypass valve 235 is open, oil may be directed around oil cooler 220, as depicted via arrow 210. Alternatively, under conditions where bypass valve 235 is closed, the oil may be directed through oil cooler 220, as depicted via arrow 206. In some examples, an oil temperature sensor 209 may be included in the second conduit. There may be more than one open configuration corresponding to bypass valve 235 (e.g. first open position and second open position), and a single closed configuration (e.g. closed position or first closed position), which will be elaborated below. Circumstances where oil is prevented from flowing through bypass valve 235 and around oil cooler 220, and instead is directed to flow through oil cooler 220, may be referred to as oil flow through a first path. Alternatively, under circumstances where oil is allowed to flow around the oil cooler, oil flow may be referred to as flowing along a second path. Thus, discussed herein the first path refers to oil flow through the oil cooler and the second path refers to oil flow around the oil cooler. In some examples, the second path may include oil both bypassing the oil cooler and some amount of oil flowing through the oil cooler.

Whether oil flow is via the first path or the second path, oil flow continues to flow through oil filter 225, as indicated via arrow 212. Arrow 212 may represent a third conduit, for example. In some examples, an oil temperature sensor 213 may be included in the conduit (e.g. third conduit) between the oil cooler and oil filter 225. Oil filter 225 may function to clean the oil entering the engine. Once oil has passed through oil filter 225, the oil may be delivered to engine 10 as depicted via arrow 214. Arrow 214 may represent a fourth conduit, for example. After oil has been delivered to engine 10, excess engine oil may then drain back to sump 240 as depicted via arrow 216. In some examples arrow 216 may be a fifth conduit. Additionally or alternatively, arrow 216 may simply represent engine oil draining from the engine back to the sump in absence of a physical conduit for the transfer of oil back to the sump.

Thus, based on the above, it may be understood that the engine lubrication system 200 may include a variable displacement or variable pressure oil pump, of which an output oil flow (e.g. output pressure in kPa) may be regulated via an electro-mechanical actuator (e.g. solenoid valve) under control of the controller and as a function of a number of operating parameters including but not limited to oil temperature, engine speed (RPM) and engine load. Oil pressure output from the oil pump may passively actuate the bypass valve 235, for directing oil to flow either through or around the oil cooler. Accordingly, the controller may control pressure of oil output from the oil pump differentially depending on whether it is desirable to route oil through the oil cooler where it may be cooled, or around the oil cooler to avoid being cooled, as a function of engine operating conditions. Examples of how the passive bypass valve is actuated are discussed in detail below with regard to FIGS. 3A-3C.

Turning now to FIGS. 3A-3C, they depict example illustrations (305, 340 and 380) of various positions or configurations that the bypass valve may adopt, along with an indication of where oil flow is directed depending on the various positions or configurations.

At FIG. 3A, the bypass valve 235 is shown in a first open position. Bypass valve 235 includes body 310, plunger 308, and spring 312. Bypass valve 235 further includes a first channel 315, and a second channel 318. The first channel may receive oil for biasing the position of plunger 308, while second channel 318 may be a channel that selectively allows or prevents oil from bypassing the oil cooler. In some examples, the first channel is perpendicular to the second channel. Spring 312 biases plunger 308 in the direction of arrow 320, whereas pressure of oil output from the oil pump (e.g. oil pump 180 at FIG. 2) flowing into first channel 315 provides a counter force to spring 312 in the direction of arrow 322. Thus, it may be understood that oil flow through the first channel 315 acts on plunger 308 to counter the bias of spring 312. Plunger 308 includes three thick regions and two thin regions. Specifically, plunger 308 includes first thick region 326, second thick region 328 and third thick region 330. It may be understood that each of the first thick region 326, second thick region 328, and third thick region 330 may sealingly engage with inner walls 336 of bypass valve 235. In other words, a circumference of the first, second and third thick regions may be similar to an inner circumference of bypass valve 235 defined by inner walls 336 so that the thick regions sealingly engage with the inner walls of bypass valve 235. Said another way, the thick regions may refer to regions where the thickness of the plunger is equal to or substantially similar to (e.g. within 1-2% of) an inner circumference of the bypass valve.

First thin region 332 may couple first thick region 326 to second thick region 328, and second thin region 334 may couple second thick region 328 to third thick region 330. It may be understood that the first thin region and the second thin region may not sealingly engage with the inner walls 336 of the bypass valve. The thin regions may refer to regions where the thickness of the plunger is less than the inner circumference of the bypass valve.

Operation of the bypass valve as depicted at FIG. 3A will now be discussed. Oil flow from the oil pump may flow through first channel 315, and the pressure of the oil may act on plunger 308 in the direction of arrow 322. At FIG. 3A, oil pressure is such that the oil pressure overcomes the force of spring 312, thus aligning the second channel 318 with first thin region 332. With second channel 318 aligned with first thin region 332, oil may flow through the bypass valve as depicted via arrow 323, thus bypassing the oil cooler (refer to the X along arrow 321 which indicates that flow through the oil cooler is significantly reduced (or prevented). Accordingly, FIG. 3A depicts bypass valve 235 in the first open position as discussed. It may be understood that bypass valve 235 is passive in the sense that the controller does not specifically command the bypass valve to a particular position, but instead indirectly controls the position that the bypass valve adopts by regulating pressure output from the oil pump.

Proceeding to FIG. 3B, it depicts the same bypass valve 235 as that depicted at FIG. 3A, and thus not all numerals at FIG. 3B are replicated for clarity and brevity. FIG. 3B depicts bypass valve 235 in the closed configuration. Specifically, oil flow from the pump is not of a high enough pressure to fully overcome the force of spring 312. Instead, the combination of the force of spring 312 acting in the direction of arrow 320 and the force imparted against the spring by plunger 308 in the direction of arrow 322 are such that the second thick region 328 aligns with the second channel 318, thereby completely blocking off the second channel and preventing oil flow through the bypass valve via the second channel. Accordingly, flow through the bypass valve to bypass the oil cooler is prevented, as indicated via the "X" over arrow 323. With flow through the bypass valve blocked via the second thick region preventing oil flow through the second channel 318, oil flows through the oil cooler as indicated via arrow 321.

Proceeding to FIG. 3C, it depicts the same bypass valve 235 as that depicted at FIG. 3A and FIG. 3B, and thus not all numerals at FIG. 3C are replicated for clarity and brevity. FIG. 3C depicts bypass valve 235 in a fuel economy mode of operation, as the oil cooler is bypassed to reduce a load on the oil pump, which may thereby improve fuel economy. FIG. 3C depicts bypass valve 235 in the second open position. Specifically, oil flow from the pump is not of a high enough pressure (refer to arrow 322) to overcome the force of spring 312 (refer to arrow 320), and thus the second thin region 334 of plunger 308 aligns with second channel 318. Accordingly, flow through the bypass valve to bypass the oil cooler is enabled, as illustrated by arrow 323. With the flow through the bypass valve by way of the second channel enabled, oil flow through the oil cooler is reduced (or prevented), as indicated via the "X" along arrow 321.

With regard to FIGS. 3A-3C, it may be understood that the bypass valve (e.g. bypass valve 235 at FIG. 2) may be biased to the first open position when oil pressure acting on the plunger is of a first pressure range. In one example, the first pressure range may include pressure greater than 5 bar (>500 kPa). It may be further understood that the bypass valve may be biased to the closed position when oil pressure acting on the plunger is within a second pressure range. As an example, the second pressure range may include pressure of 2.5-4 bar (250-400 kPa). Furthermore, it may be understood that the bypass valve may be biased to the second open position when oil pressure acting on the plunger is within a third pressure range. As an example, the third pressure range may include pressure of 1-2 bar (100-200 kPa). Accordingly, it may be understood that the bypass valve may be in the first open position at a high oil pressure, may be in the closed position at a medium oil pressure, and may be in the second open position at a low oil pressure. As mentioned above with regard to FIG. 1, the oil pump valve (e.g. oil pump valve 182 at FIG. 1) may have a default pressure regulation set point that is higher than the maximum oil pressure requirement of the engine at all conditions. The default pressure regulation set point may be such that the bypass valve is in the first open position at the default pressure regulation set point.

Thus, discussed herein, a system for a vehicle may include a variable flow oil pump that provides an oil to an engine for lubrication purposes by way of an oil circuit, and oil cooler, and an oil cooler bypass valve. The system may further include a controller with computer readable instructions stored on non-transitory memory that when executed, cause the controller to determine an operating condition of the engine, and command the variable flow oil pump to pump the oil at a determined pressure that includes one of a first pressure, a second pressure or a third pressure as a function of the operating condition of the engine. The determined pressure may passively adjust a position of the oil cooler bypass valve so as to prevent or enable the oil to bypass the oil cooler.

For such a system, the oil cooler bypass valve may be a three-state valve that adopts a first open position when the determined pressure is the first pressure, adopts a closed position when the determined pressure is the second pressure, and adopts a second open position when the determined pressure is the third pressure. The first pressure may be greater than the second pressure, which is in turn may be greater than the third pressure. The oil may be prevented from bypassing the oil cooler when the oil cooler bypass valve is in the closed position, but may be allowed to bypass the oil cooler when the oil cooler bypass valve is in the first open position and the second open position.

For such a system, the system may further comprise a coolant system that flows a coolant through the oil cooler to allow heat transfer between the oil and the coolant.

For such a system, the controller may store further instructions to first command the variable flow oil pump to pump the oil at the first pressure at a cold-start event of the engine until the oil circuit is pressurized to above a predetermined oil circuit pressure, then command the variable flow oil pump to pump the oil at the second pressure to raise a temperature of the oil to within a threshold of a predetermined oil temperature. Responsive to the temperature of the oil being within the threshold of the predetermined oil temperature, the instructions may include commanding the variable flow oil pump to pump the oil at the third pressure. In such a system, the controller may store further instructions to determine whether the temperature of the oil has reached a threshold oil temperature that is greater than the predetermined oil temperature while the variable flow oil pump is commanded to pump the oil at the third pressure. The controller may store further instructions to command the variable flow oil pump to pump the oil at the second pressure to lower the temperature of the oil to within the threshold of the predetermined oil temperature in response to the temperature of the oil reaching the threshold oil temperature while the variable flow oil pump is commanded to pump the oil at the third pressure.

Turning now to FIG. 4, an example method 400 for controlling oil pressure that in turn biases a flow of oil through the oil cooler or around (e.g. bypassing) the oil cooler is shown. Specifically, method 400 depicts example methodology for controlling an oil pressure by controlling the oil pump (e.g. 180) and/or oil pump valve (e.g. oil pump valve 182 at FIG. 1), which in turn causes the oil cooler bypass valve (e.g. oil cooler bypass valve 235 at FIG. 2) to adopt various configurations which either result in oil being routed through the oil cooler or bypassing the oil cooler. The controlling of the oil pressure may be based on vehicle operating conditions, as will be elaborated below.

Method 400 will be described with reference to the systems and components described herein and shown in FIGS. 1-3C, though it will be appreciated that similar methods may be applied to other systems and components without departing from the scope of this disclosure. Instructions for carrying out method 400 and the rest of the methods included herein may be executed by a controller, such as controller 12 at FIG. 1, based on instructions stored in non-transitory memory, and in conjunction with signals received from sensors of the engine system and vehicle powertrain as discussed with regard to FIGS. 1-2. The controller may employ actuators such as the oil pump valve (e.g. oil pump valve 182 at FIG. 1), oil pump (e.g. oil pump 180 at FIG. 1) etc., to alter state of devices in the physical world according to the methods depicted below.

Method 400 begins at 405 and includes estimating and/or measuring vehicle operating conditions. Operating conditions may be estimated, measured, and/or inferred, and may include one or more vehicle conditions, such as vehicle speed, vehicle location, etc., various engine conditions, such as engine status, engine temperature, engine oil temperature, coolant temperature, engine load, engine speed, A/F ratio, manifold air pressure, etc., various fuel system conditions, such as fuel level, fuel type, fuel temperature, etc., as well as various ambient conditions, such as ambient temperature, humidity, barometric pressure, etc.

Proceeding to 410, method 400 includes indicating whether cold-start conditions are met for starting the engine. In other words, at 410, method 400 includes indicating whether an engine start is being requested, and whether that engine start event qualifies as a cold-start of the engine. Cold-start conditions being met may include one or more of an engine temperature below a threshold engine temperature, a coolant temperature below a threshold coolant temperature, ambient temperature below a threshold ambient temperature, exhaust catalyst temperature below a threshold exhaust catalyst temperature, etc.

If, at 410, cold-start conditions are not indicated to be met, method 400 may proceed to 415. At 415, method 400 includes maintaining current operating conditions. For example, if the vehicle is already in operation with the engine combusting air and fuel, then the variable flow oil pump may be continued to be controlled as a function of current operating conditions. For example, if engine oil temperature is already within a threshold of a desired engine oil temperature and engine operating conditions are mild (e.g. engine load below a threshold engine load, engine speed below a threshold engine speed, etc.), then method 400 may include commanding a low output pressure from the oil pump (e.g. 100-200 kPa) to control or maintain the bypass valve (e.g. bypass valve 235 at FIG. 2) in the second open position (refer to FIG. 3C). Commanding the low output pressure may include controlling a PWM signal of the oil pump valve (e.g. oil pump valve 182) to achieve the low output pressure from the oil pump, in one example. With the bypass valve in the second open position, the oil cooler (e.g. oil cooler 220 at FIG. 2) may be bypassed which may reduce pressure loss through the oil cooler and thus reduce the oil pump power consumption, thereby improving fuel economy. In such an example, if engine operating conditions change, then it may be understood that the controller may command a different output pressure from the oil pump in order to control the oil cooler bypass valve to a desired state, as will be discussed in further detail below. Method 400 may then end. In some examples, it may be understood that method 400 may end in response to a vehicle-off event where the engine is deactivated.

Returning to 410, in response to cold-start conditions being met, method 400 proceeds to 420. At 420, method 400 includes controlling output pressure of oil from the oil pump to the first pressure range. As discussed above, the first pressure range may include pressure greater than 500 kPa, and the oil pump valve (e.g. oil pump valve 182 at FIG. 1) may have a default pressure regulation set point under conditions where the solenoid valve is de-energized. The default pressure may be higher than a maximum oil pressure requirement of the engine at all conditions, and may be greater than 500 kPa. Thus, controlling the oil pump valve at step 420 may include de-energizing the oil-pump valve so the oil pump outputs the default pressure which corresponds to a pressure greater than 500 kPa. With the oil pump outputting the default pressure, it may be understood that the oil cooler bypass valve (e.g. bypass valve 235 at FIG. 2) may adopt the first open position (see FIG. 3A). Accordingly, with the bypass valve in the first position, the oil cooler may be bypassed. This may enable rapid pressurization of the engine oil circuits, which may be advantageous over methods which route oil through the oil cooler initially upon a cold-start request. It may be understood that oil circuits as discussed above may refer to any conduits, lines, etc., that receive oil. Thus, by controlling output pressure of the oil pump to the first pressure range (e.g. >500 kPa), the oil pressure acting on the bypass valve serves to force the bypass valve to the first open position which thereby routes the oil around the oil cooler. Because the output pressure is high, engine oil circuits may rapidly pressurize as compared to methodology where oil is routed through the oil cooler.

Accordingly, proceeding to 425, method 400 includes monitoring oil pressure in the oil circuits. For example, the oil pressure sensor (e.g. pressure sensor 188 at FIG. 1) may be relied upon for monitoring oil pressure in the oil circuits. Based on the information regarding oil pressure in the oil circuits obtained at 425, method 400 continues to 430 where method 400 judges whether a desired oil pressure in the oil pressure circuits has been reached or attained. The desired oil pressure may be a preset oil pressure, for example, stored at the controller. If, at 430, the desired oil pressure is indicated to have been reached or exceeded, then method 400 may proceed to 435. Alternatively, if the desired oil pressure has not been reached at 430, then method 400 returns to 420 where the oil pump valve is continued to be controlled in a manner so as to regulate output pressure from the oil pump to the first pressure range.

In response to the desired oil pressure being reached or exceeded at 430, method 400 proceeds to 435. At 435, method 400 includes commanding the oil pump valve to control oil pressure to the second oil pressure range. As discussed above, the second oil pressure range may include pressure of 250-400 kPa. Again, control over the output oil pressure from the oil pump may be regulated by the controller controlling an operational state of the oil pump valve. For example, the controller may control a PWM signal for current sent to the oil pump valve to control the output oil pressure to 250-400 kPa. As discussed above, with oil pressure output from the oil pump corresponding to the second oil pressure range, the force of the oil acting on the oil cooler bypass valve may be lower than when the oil pressure output is of the first pressure range, which may cause the bypass valve to adopt the closed position (see FIG. 3B). With the bypass valve in the closed position, oil is prevented from bypassing the oil cooler, and thus flows through the oil cooler. An advantage of routing the oil through the oil cooler is that the oil may be warmed due to the fact that engine coolant warms faster than oil. Specifically, when coolant temperature is greater than that of the oil flowing through the oil cooler, the warmer coolant may transfer heat energy to the oil, thereby raising the temperature of the oil. Raising the temperature of the oil in such a fashion during a cold-start may serve an advantage in that fuel economy may be improved as compared to a situation where it takes a longer period of time to raise the temperature of the engine oil.

Accordingly, with oil flowing through the oil cooler due to the output pressure from the oil pump being controlled to the second pressure range thereby causing the bypass valve to close, method 400 proceeds to 440. At 440, method 400 includes monitoring engine oil temperature. Engine oil temperature may be monitored post-oil cooler, for example via an engine oil temperature sensor (e.g. engine oil temperature sensor 213 at FIG. 2). Proceeding to 445, method 400 may include judging whether oil temperature is within a threshold of (e.g. within 5% or less of) a desired or predetermined engine oil temperature. The predetermined engine oil temperature may be stored at the controller, for example. If the oil temperature is not within the threshold of the predetermined engine oil temperature, then method 400 may return to step 435 where the controller may continue to exert control over the oil pump valve to control output pressure to the second pressure range such that the engine oil may be raised to within the threshold of the desired temperature.

In response to the oil temperature being within the threshold of the desired temperature, method 400 proceeds to 450. At 450, method 400 includes commanding the oil pump valve to control the output oil pressure from the oil pump to the third pressure range. As discussed above, the third pressure range may include a pressure of 100-200 kPa. When the output oil pressure from the oil pump is within the third pressure range, the oil pressure may not be high enough to overcome the force of the spring (e.g. spring 312 at FIG. 3C), and thus the bypass valve may adopt the second open configuration (refer to FIG. 3C). When in the second open configuration, the oil cooler may again be bypassed. In other words, after the engine oil has been heated to within the threshold of the desired temperature, it may be desirable to bypass the engine oil cooler to reduce the load on the pump, which may thereby improve fuel economy. It may be understood that the oil pressure output from the oil pump being controlled to the third pressure range may be in response to engine oil temperature becoming within the threshold of the desired engine temperature and further in response to an indication of mild engine operating conditions, where mild engine operating conditions may define most customer drive cycles where engine load is below a threshold engine load and engine speed is below a threshold engine speed.

While the output oil pressure from the oil pump is controlled to the third pressure range such that the engine oil flow bypasses the oil cooler, method 400 may proceed to 455 where engine oil temperature is continued to be monitored. Again, engine oil temperature may be monitored via an engine oil temperature sensor (e.g. engine oil temperature sensor 213 at FIG. 2). Proceeding to 460, method 400 includes indicating whether conditions are met for cooling the oil. For example, engine oil temperature above a second engine oil temperature threshold that is greater than the desired engine oil temperature, may be an indication that oil cooling is needed. Additionally or alternatively, engine load above the threshold engine load and/or engine speed above the threshold engine speed may be indicative of a need for cooling the engine oil. In other words, a transition from mild to more aggressive engine operating conditions may correspond to a situation where conditions are met for cooling the engine oil.

If, at 460, conditions are met for engine oil cooling, then method 400 may return to step 435 where the output oil pressure is commanded to be within the second pressure range such that the bypass valve closes. With the bypass valve closed, engine oil may be directed through the oil cooler. In a case where engine oil is above the second engine oil temperature threshold, it may be understood that the coolant circulating through the oil cooler may be at a temperature lower than that of the oil. As such the oil cooler may enable the coolant to absorb heat energy from the oil to thereby cool the oil. With the oil pump valve commanded in a manner so as to control the output pressure of the oil pump to the second range, method 400 may continue to monitor the temperature of the circulating oil. Once the oil temperature is within the threshold of the desired temperature, the oil pump output pressure may again be controlled to the third pressure range so as to bypass the oil cooler.

Returning to 460, in response to an indication that conditions are not met for oil cooling, method 400 may proceed to 465. At 465, method 400 includes indicating whether vehicle operation has been discontinued. Specifically, at step 465, method 400 judges whether a vehicle-off event is occurring where the engine is being shut down. If so, then method 400 may end. Alternatively, method 400 may return to 450 where oil pump output pressure is continued to be controlled to the third pressure range.

Thus, discussed herein, a method may include controlling an oil pump to pump an oil for lubricating an engine at a first pressure, a second pressure or a third pressure to bias an oil cooler bypass valve to a first position, a second position or a third position, respectively, as a function of engine operating conditions, to selectively route the oil through or around an oil cooler.

For such a method, the first position may be a first open position where the oil is routed around the oil cooler, where the second position may be a closed position where oil is prevented from being routed around the oil cooler, and where the third position may be a second open position where the oil is routed around the oil cooler.

For such a method, the first pressure may be greater than the second pressure, which may in turn be greater than the third pressure.

For such a method, the oil cooler bypass valve may passively respond to pressure of the oil in order to adopt the first position, the second position and/or the third position.

For such a method, the oil pump may be a variable displacement oil pump.

For such a method, controlling the oil pump may include adjusting a position of a solenoid valve of the oil pump based on a command from a controller. In such an example, the oil cooler bypass valve may not be communicably coupled to the controller.

For such a method, the first pressure may be greater than 500 kPa, the second pressure may be between 250-400 kPa, and the third pressure may be between 100-200 kPa.

For such a method, the oil cooler may be a coolant-to-oil heat exchanger where heat energy is transferred between a coolant circulating through the oil cooler and the oil.

For such a method, the method may further comprise biasing the oil cooler bypass valve to the first position at a cold-start event of the engine where a temperature of the oil is more than a threshold below a predetermined oil temperature and where a circuit that receives the oil is below a predetermined circuit pressure. The method may further include biasing the oil cooler bypass valve to the second position to control the temperature of the oil to within the threshold of the predetermined oil temperature. The method may still further include biasing the oil cooler bypass valve to the third position when the temperature of the oil is within the threshold of the predetermined oil temperature.

Another example of a method may include controlling whether an oil used for lubricating an engine is routed through or around an oil cooler solely by adjusting a pressure of the oil emanating from an oil pump to bias an oil cooler bypass valve to a first open position under a first operating condition, to a closed position under a second operating condition, and a second open position under a third operating condition.

For such a method, the first operating condition may include a cold-start of the engine where pressure of an oil circuit that receives the oil is below a threshold circuit pressure and a temperature of the oil is not within a threshold of a predetermined oil temperature. The second operating condition may include the oil circuit pressurized to above the threshold circuit pressure and where the temperature of the oil is not within the threshold of the predetermined temperature. The third operating condition may include the oil circuit pressurized to above the threshold pressure and the temperature of the oil within the threshold of the predetermined temperature.

For such a method, biasing the oil cooler bypass valve to the first position may allow the oil to bypass the oil cooler. Further, biasing the oil cooler bypass valve to the closed position may prevent the oil from bypassing the oil cooler. Biasing the oil cooler bypass valve to the second open position may additionally allow the oil to bypass the oil cooler.

For such a method, the oil cooler may additionally receive a coolant from a coolant system. Heat may be transferred from the oil to the coolant or vice versa with the oil cooler bypass valve closed under the second operating condition.

For such a method, the oil pump may be a variable flow oil pump. The pressure of the oil emanating from the oil pump may be adjusted based on a command from a controller to a valve associated with the oil pump.

Turning now to FIG. 5, an example timeline 500 depicts a prophetic example of how oil pump output pressure may be controlled in order to bias the oil cooler bypass valve to desired positions depending on vehicle operating conditions. Timeline 500 includes plot 505, indicating whether cold-start conditions are indicated to be met (yes or no), over time. Timeline 500 further includes plot 510, indicating oil pump output pressure, over time. As discussed above with regard to FIGS. 3A-4, oil pump output pressure may be controlled to a first pressure range (1), a second pressure range (2), a third pressure range (3), or the pump may be off. Timeline 500 further includes plot 515, indicating a position of the oil cooler bypass valve (e.g. bypass valve 235 at FIG. 2), over time. As discussed above with regard to FIGS. 3A-4, the oil cooler bypass valve may be in a first open position (refer to FIG. 3A), a closed position (refer to FIG. 3B), or a second open position (refer to FIG. 3C). Timeline 500 further includes plot 520, indicating whether a circuit or circuits (e.g. conduits, oil injector(s), lines, etc.) that receive oil from the oil pump (e.g. oil pump 180 at FIG. 1) are pressurized to a desired level (yes or no), over time. Timeline 500 further includes plot 525, indicating a temperature of the oil, over time. The engine oil may increase (+) or decrease (−) in temperature over time.

At time t0 it may be understood that the engine is off and the vehicle is stationary. There is no request for an engine startup, and thus cold-start conditions are not yet met (plot 505). With the vehicle off, there is no oil pump output pressure (plot 510). The bypass valve (plot 515) is in the second open position (refer to FIG. 3C) because there is no oil pressure to overcome the force of the spring (e.g. spring 312 at FIG. 3C) associated with the bypass valve. With the vehicle off, oil circuits that receive oil from the oil pump are not pressurized (plot 520), and oil temperature is low (plot 525).

At time t1, cold-start conditions are indicated to be met. For example, at time t1 there is a request for an engine startup (e.g. remote start request, driver turning a key to initiate engine operation, driver pressing a button on the vehicle dash to initiate engine operation, etc.), and it is indicated that the request is a cold-start request. As discussed above at step 410 of method 400, cold-start conditions may be met when one or more of engine temperature is below a threshold engine temperature, temperature of coolant is below a threshold coolant temperature, ambient temperature is below a threshold ambient temperature, exhaust catalyst temperature is below a threshold exhaust catalyst temperature, etc.

With an engine cold-start indicated, at time t1 the oil pump (e.g. oil pump 180 at FIG. 1) is controlled in a manner so as to produce an output oil pressure within the first pressure range (e.g. >500 kPa). As discussed above, oil pump output pressure may be regulated via a solenoid valve (e.g. oil pump valve 182 at FIGS. 1-2) under control of the controller (e.g. controller 12 at FIG. 1). The oil pump valve may have a default pressure regulation set point under conditions where the solenoid valve is de-energized, and the default pressure may be greater than a maximum oil pressure requirement of the engine at all conditions, and thus the default pressure may be greater than 500 kPa. Thus, at time t1, controlling the oil pump output pressure to the first pressure range may include de-energizing or maintaining de-energized the oil pump valve. Accordingly, between time t1 and t2 oil pump output pressure rises to the first pressure range. As the oil pump output is controlled to the first pressure range, the bypass valve passively adopts the first open position (refer to FIG. 3A) at time t2, whereby the oil cooler is bypassed.

As discussed above, the high pressure output (e.g. pressure output in the first pressure range) of the oil pump may serve to pressurize the oil circuit(s). By regulating the bypass valve to the first open position, the restrictive oil cooler may be bypassed, which may enable rapid pressurization of the oil circuits in a manner faster than if the oil were directing through the oil cooler. For determining whether the oil circuits are pressurized to a desired level, an oil pressure sensor (e.g. oil pressure sensor 188 at FIG. 1) may be relied upon for communicating oil pressure in the oil circuits to the controller. At time t3, it is indicated that the oil circuits are sufficiently pressurized (plot 520). In response to the indication that the oil circuits are sufficiently pressurized, the oil pump output pressure is controlled to the second pressure range (e.g. 250-400 kPa) (plot 510) between time t3 and t4. With the oil pump output pressure controlled to the second pressure range, the bypass valve passively responds to the change in oil pump output pressure, to adopt the closed position (refer to FIG. 3B) at time t4. As discussed above, the closed position of the bypass valve thus directs the oil emanating from the oil pump through the oil cooler. It may be beneficial to direct the oil through the oil cooler at time t4 due to a temperature of the coolant (not shown) being greater than a temperature of the oil (plot 525), because coolant increases in temperature at a cold-start faster than engine oil. Thus, transfer of heat from the coolant to the engine oil that takes place in the oil cooler may increase temperature of the oil faster than if the oil cooler were continued to be bypassed once the oil circuits are pressurized.

Thus, prior to time t4 it can be seen at timeline 500 that oil temperature rises at a slower rate than between time t4 and t5. In other words, the rate of increase in oil temperature is greater between time t4 and t5 than prior to time t4, due to the oil being directed through the oil cooler between time t4 and t5.

At time t5, temperature of the oil becomes within a threshold (line 526) of the desired or predetermined engine oil temperature (represented by line 527). Accordingly, cold-start conditions are no longer indicated (plot 505), and the oil pump is controlled to output oil pressure within the third pressure range (e.g. 100-200 kPa). While not explicitly illustrated, it may be understood that the operating conditions are mild (e.g. engine speed below the engine speed threshold and engine load below the engine load threshold), thus it is desirable to control the oil pump to output oil pressure to within the third pressure range. Between time t5 and t6, oil pump output pressure is controlled (via controlling the oil pump valve) to within the third pressure range (plot 510). As the pressure decreases from the second pressure range to the third pressure range, the oil cooler bypass valve (plot 515) passively adopts the second open position (refer to FIG. 3C) at time t6. Thus, with the bypass valve in the second open position the oil cooler is once again bypassed. Bypassing the oil cooler under mild engine operating conditions may serve to reduce oil pressure losses compared to if the oil flow was continued to be directed through the oil cooler. Reducing the pressure loss through the oil cooler may reduce oil pump power consumption, thereby improving fuel economy.

Some amount of time passes between time t6 and t7. At time t7, engine oil temperature rises to above the second oil temperature threshold (line 528), and thus there is a request for engine oil cooling. Accordingly, between time t8 and t9, the oil pump output pressure is controlled back to the second pressure range (plot 510). Increasing the output pressure from the oil pump results in the bypass valve passively adopting the closed position (plot 515) at time t9. With the bypass valve in the closed position, oil emanating from the oil pump is once again directed through the oil cooler. While not explicitly illustrated, it may be understood that at time t9 oil temperature is greater than the temperature of the coolant. Thus, transfer of heat from the oil to the coolant occurs between time t9 and t10, thereby cooling the oil. At time t10, engine oil temperature is once again within the threshold (refer to line 526) of the desired or predetermined oil temperature (line 527). With the engine oil temperature having sufficiently cooled at time t10, oil pump output pressure is once again controlled to the third pressure range (plot 510) between time t10 and t11, and at t11 the bypass valve passively adopts the second open position (plot 515). After time t11 oil temperature remains within the threshold of the desired oil temperature, oil pump output pressure is continued to be controlled to the third pressure range, and the bypass valve is maintained in the second open position where the oil cooler is bypassed to improve fuel economy.

Turning now to FIG. 6, a high-level example method 600 is shown for determining whether the oil cooler bypass valve (e.g. bypass valve 235 at FIG. 2) is degraded or is functioning as desired or expected. Specifically, method 600 may be used under conditions where switching from bypassing the oil cooler (e.g. oil cooler 220) to routing oil through the oil cooler is expected to result in a change in oil temperature due to a difference in temperature between the engine oil and the coolant. If the expected change is not observed, then the bypass valve may be degraded.

Method 600 will be described with reference to the systems and components described herein and shown in FIGS. 1-3C, though it will be appreciated that similar methods may be applied to other systems and components without departing from the scope of this disclosure. Instructions for carrying out method 600 and the rest of the methods included herein may be executed by a controller, such as controller 12 at FIG. 1, based on instructions stored in non-transitory memory, and in conjunction with signals received from sensors of the engine system and vehicle powertrain as discussed with regard to FIGS. 1-2. The controller may employ actuators such as the oil pump valve (e.g. oil pump valve 182 at FIG. 1), etc., to alter state of devices in the physical world according to the methods depicted below.

Method 600 begins at 605 and includes indicating whether conditions are met for determining potential bypass valve degradation. Conditions may be met based on one or more of the following examples. In one example, conditions may be met when there is a request to switch from bypassing oil flow through the oil cooler to directing the oil flow through the oil cooler. Conditions may be met when a temperature of engine oil is greater than that of coolant by a predetermined threshold difference, in an example. In another example, conditions may be met when temperature of engine oil is less than that of coolant by another predetermined threshold difference. Conditions may be met under circumstances where there is not any inferred degradation of the oil cooler, coolant system, engine oil pump, oil pump valve, engine oil temperature sensors, coolant temperature sensors, etc.

If, at 605, conditions are not indicated to be met for determining bypass valve degradation, then method 600 may proceed to 610 where current operating conditions may be maintained. For example, if the oil cooler is bypassed, then such conditions may be maintained in an absence of a request to route oil through the oil cooler. In another example, if the oil cooler is not bypassed, then such conditions may be maintained in an absence of a request to bypass the oil cooler. In some examples where the difference between coolant temperature and engine temperature is not greater than the predetermined threshold difference, but where a switch from bypassing the oil cooler to routing oil through the oil cooler (or vice versa) is requested, then the switch may be carried out as discussed above but the degradation test may not be conducted due to potential signal-to-noise issues. Method 600 may then end.

Alternatively, in response to conditions being met for determining bypass valve degradation, method 600 proceeds to 615. At 615, method 600 includes conducting the switch from bypassing the oil cooler to routing oil through the oil cooler. In one example, conducting the switch may include controlling the output pressure of the oil pump from the first pressure range to the second pressure range. As another example, conducting the switch may include controlling the output pressure of the oil pump from the third pressure range to the second pressure range. Said another way, conducting the switch may include controlling the oil pump in a manner to bias the bypass valve from the first open position (refer to FIG. 3A) to the closed position (refer to FIG. 3B), or controlling the oil pump in a manner to bias the bypass valve from the second open position (refer to FIG. 3C) to the closed position (refer to FIG. 3B). It may be understood that prior to making the switch both engine oil temperature and coolant temperature may be retrieved from respective sensors and stored at the controller.

In response to the switch being conducted, method 600 proceeds to 620. At 620, method 600 includes monitoring engine oil temperature. While not explicitly illustrated, it may be understood that coolant temperature may additionally or alternatively be monitored.

Proceeding to 625, method 600 includes determining whether a change in the engine oil temperature (e.g. difference in the temperature of oil prior to the switch and after the switch) is within a threshold (e.g. within 5% of, within 10% of, within 20% of, within 50% of etc.) of an expected engine oil temperature change. For example, if engine oil temperature was greater than the coolant temperature prior to the switch, then it may be expected that engine oil temperature may cool in response to the switch. Alternatively, if engine oil temperature was less than the coolant temperature prior to the switch, then it may be expected that engine oil temperature may rise in response to the switch. The expected difference may be determined via the controller, and may be a function of variables including but not limited to ambient temperature, coolant flow rate, engine oil flow rate, engine oil volume, etc.

If, at 625, it is determined that the change in engine oil temperature is not within the threshold of the expected engine oil temperature change, then method 600 proceeds to 630 where bypass valve degradation is indicated. For example, because the change in oil temperature was not within the threshold of the expected temperature change, the bypass valve may not be functioning as desired. Specifically, the bypass valve may be stuck in any one of the first open position, the second open position, or closed position such that when the switch is commanded the bypass valve does not respond as expected and, as a result, engine oil temperature does not undergo the expected change in temperature.

Proceeding to 635, method 600 includes updating vehicle operating conditions. Updating vehicle operating conditions may include storing the results of the test at the controller, setting diagnostic trouble code (DTC) and illuminating a malfunction indicator light (MIL) at the vehicle dash to alert the vehicle operator of a request to have the vehicle serviced. Method 600 may then end.

Returning to 625, responsive to an indication that the change in engine oil temperature is within the threshold of the expected temperature change, method 600 proceeds to 640. At 640, method 600 includes indicating that the bypass valve is functioning as desired or expected. Proceeding to 635, the passing result may be stored at the controller. Method 600 may then end.

While the above discussion with regard to method 600 centered on engine oil temperature changes, coolant temperature changes may additionally or alternatively be monitored in similar fashion to infer whether the bypass valve is functioning as desired. For example, if coolant temperature is lower than engine oil temperature before a switch from bypassing the oil cooler to routing engine oil through the oil cooler, then it may be expected that coolant temperature may increase by a predetermined amount. If the coolant temperature does not increase to within a threshold of the predetermined amount, then degradation of the bypass valve may be inferred. As another example, if coolant temperature is greater than engine oil temperature before a switch from bypassing the oil cooler to routing engine oil through the oil cooler, then it may be expected that coolant temperature may decrease by another predetermined amount. If the coolant temperature does not decrease to within a threshold of the other predetermined amount, then degradation of the bypass valve may be inferred.

Furthermore, while the above discussion with regard to method 600 centered on the switch being from bypassing the oil cooler to routing engine oil through the oil cooler, similar methodology may be utilized for a switch from routing engine oil through the oil cooler to bypassing the engine oil cooler without departing from the scope of this disclosure.

In this way, under mild driving conditions where vehicles tend to spend most of their time, an oil cooler may be bypassed which may improve fuel economy by reducing a load on the oil pump. Additionally, bypassing the oil pump initially at a cold-start event may enable faster time-to-desired oil pressure as opposed to other methods that route oil through the oil cooler initially at cold-start events.

The technical effect of combining a passive three-state oil cooler bypass valve and a variable flow oil pump is to enable a change in oil pressure as commanded via a controller to influence whether the oil cooler is bypassed or not. Specifically, low, medium and high oil pressure set points for controlling the bypass valve position may be designed such that oil pressure requirements for the engine are met at each different pressure set point, and the bypass valve will automatically (e.g. passively) adopt the appropriate position for routing oil either around the oil cooler or through the oil cooler such that oil temperature can be maintained at a temperature appropriate for different engine operational conditions. In this way, reliance on additional actuators including but not limited to wax thermostat of electromagnetic solenoid valves for bypassing the oil cooler may be avoided, thus removing sources of potential degradation.

The systems discussed herein and with regard to FIGS. 1-3C, along with the methods discussed herein and with regard to FIG. 4 and FIG. 6, may enable one or more systems and one or more methods. In one example, a method comprises controlling an oil pump to pump an oil for lubricating an engine at a first pressure, a second pressure or a third pressure to bias an oil cooler bypass valve to a first position, a second position or a third position, respectively, as a function of engine operating conditions, to selectively route the oil through or around an oil cooler. In a first example of the method, the method further includes wherein the first position is a first open position where the oil is routed around the oil cooler, where the second position is a closed position where oil is prevented from being routed around the oil cooler, and where the third position is a second open position where the oil is routed around the oil cooler. A second example of the method optionally includes the first example, and further includes wherein the first pressure is greater than the second pressure, which is in turn greater than the third pressure. A third example of the method optionally includes any one or more or each of the first through second examples, and further includes wherein the oil cooler bypass valve passively responds to pressure of the oil to adopt the first position, the second position or the third position. A fourth example of the method optionally includes any one or more or each of the first through third examples, and further includes wherein the oil pump is a variable displacement oil pump. A fifth example of the method optionally includes any one or more or each of the first through fourth examples, and further includes wherein controlling the oil pump includes adjusting a position of a solenoid valve of the oil pump based on a command from a controller. A sixth example of the method optionally includes any one or more or each of the first through fifth examples, and further includes wherein the oil cooler bypass valve is not communicably coupled to the controller. A seventh example of the method optionally includes any one or more or each of the first through sixth examples, and further includes wherein the first pressure is greater than 500 kPa, wherein the second pressure is between 250-400 kPa, and where the third pressure is between 100-200 kPa. An eighth example of the method optionally includes any one or more or each of the first through seventh examples, and further includes wherein the oil cooler is a coolant-to-oil heat exchanger where heat energy is transferred between a coolant circulating through the oil cooler and the oil. A ninth example of the method optionally includes any one or more or each of the first through eighth examples, and further comprises biasing the oil cooler bypass valve to the first position at a cold-start event of the engine where a temperature of the oil is more than a threshold below a predetermined oil temperature and where a circuit that receives the oil is below a predetermined circuit pressure; biasing the oil cooler bypass valve to the second position to control the temperature of the oil to within the threshold of the predetermined oil temperature; and biasing the oil cooler bypass valve to the third position when the temperature of the oil is within the threshold of the predetermined oil temperature.

Another example of a method comprises controlling whether an oil used for lubricating an engine is routed through or around an oil cooler solely by adjusting a pressure of the oil emanating from an oil pump to bias an oil cooler bypass valve to a first open position under a first operating condition, to a closed position under a second operating condition, and a second open position under a third operating condition. In a first example of the method, the method further includes wherein the first operating condition includes a cold-start of the engine where pressure of an oil circuit that receives the oil is below a threshold circuit pressure and a temperature of the oil is not within a threshold of a predetermined oil temperature; where the second operating condition includes the oil circuit pressurized to above the threshold circuit pressure and where the temperature of the oil is not within the threshold of the predetermined temperature; and where the third operating condition includes the oil circuit pressurized to above the threshold pressure and the temperature of the oil within the threshold of the predetermined temperature. A second example of the method optionally includes the first example, and further includes wherein biasing the oil cooler bypass valve to the first position allows the oil to bypass the oil cooler, where biasing the oil cooler bypass valve to the closed position prevents the oil from bypassing the oil cooler, and where biasing the oil cooler bypass valve to the second open position allows the oil to bypass the oil cooler. A third example of the method optionally includes any one or more or each of the first through second examples, and further includes wherein the oil cooler additionally receives a coolant from a coolant system; and wherein heat is transferred from the oil to the coolant or vice versa with the oil cooler bypass valve closed under the second operating condition. A fourth example of the method optionally includes any one or more or each of the first through third examples, and further includes wherein the oil pump is a variable flow oil pump; and wherein the pressure of the oil emanating from the oil pump is adjusted based on a command from a controller to a valve associated with the oil pump.

An example of a system for a vehicle comprises a variable flow oil pump that provides an oil to an engine for lubrication purposes by way of an oil circuit; an oil cooler; an oil cooler bypass valve; and a controller with computer readable instructions stored on non-transitory memory that when executed, cause the controller to: determine an operating condition of the engine; command the variable flow oil pump to pump the oil at a determined pressure that includes one of a first pressure, a second pressure or a third pressure as a function of the operating condition of the engine, where the determined pressure passively adjusts a position of the oil cooler bypass valve so as to prevent or enable the oil to bypass the oil cooler. In a first example of the system, the system further includes wherein the oil cooler bypass valve is a three-state valve that adopts a first open position when the determined pressure is the first pressure, adopts a closed position when the determined pressure is the second pressure, and adopts a second open position when the determined pressure is the third pressure, where the first pressure is greater than the second pressure which is in turn greater than the third pressure; and wherein the oil is prevented from bypassing the oil cooler when the oil cooler bypass valve is in the closed position, but where oil is allowed to bypass the oil cooler when the oil cooler bypass valve is in the first open position and the second open position. A second example of the system optionally includes the first example, and further comprises a coolant system that flows a coolant through the oil cooler to allow heat transfer between the oil and the coolant. A third example of the system optionally includes any one or more or each of the first through second examples, and further includes wherein the controller stores further instructions to first command the variable flow oil pump to pump the oil at the first pressure at a cold-start event of the engine until the oil circuit is pressurized to above a predetermined oil circuit pressure, then command the variable flow oil pump to pump the oil at the second pressure to raise a temperature of the oil to within a threshold of a predetermined oil temperature; and responsive to the temperature of the oil being within the threshold of the predetermined oil temperature, command the variable flow oil pump to pump the oil at the third pressure. A fourth example of the system optionally includes any one or more or each of the first through third examples, and further includes wherein the controller stores further instructions to determine whether the temperature of the oil has reached a threshold oil temperature that is greater than the predetermined oil temperature while the variable flow oil pump is commanded to pump the oil at the third pressure; and command the variable flow oil pump to pump the oil at the second pressure to lower the temperature of the oil to within the threshold of the predetermined oil temperature in response to the temperature of the oil reaching the threshold oil temperature while the variable flow oil pump is commanded to pump the oil at the third pressure.

In another representation, a method comprises in response to conditions being met for determining whether a passive three-state oil cooler bypass valve is degraded, controlling an output pressure of a variable flow oil pump to bias the bypass valve to switch from routing a flow of oil around an oil cooler to through the oil cooler, and monitoring a temperature change of the oil. In a first example of the method, the method includes indicating degradation of the bypass valve in response to the temperature change of the oil not being within a threshold of an expected temperature change.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations, and/or functions may be repeatedly performed depending on the particular strategy being used. Further, the described actions, operations, and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

As used herein, the term "approximately" is construed to mean plus or minus five percent of the range unless otherwise specified.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method comprising:

controlling an oil pump to pump an oil for lubricating an engine at a first pressure, a second pressure and a third pressure to bias an oil cooler bypass valve to a first position, a second position and a third position, respectively, as a function of engine operating conditions, to selectively route the oil through or around an oil cooler, wherein the oil cooler is a coolant-to-oil heat exchanger.

2. The method of claim 1, wherein the first position is a first open valve position where the oil is routed around the oil cooler, where the second position is a closed valve position where oil is prevented from being routed around the oil cooler, and where the third position is a second open valve position where the oil is routed around the oil cooler.

3. The method of claim 2, further comprising:

biasing the oil cooler bypass valve to the first position at a cold-start event of the engine where a temperature of the oil is more than a threshold below a predetermined oil temperature and where a circuit that receives the oil is below a predetermined circuit pressure; and then, only after biasing the oil cooler bypass valve to the first position, biasing the oil cooler bypass valve to the second position to control the temperature of the oil to within the threshold of the predetermined oil temperature; and then, only after biasing the oil cooler bypass valve to the second position, biasing the oil cooler bypass valve to the third position when the temperature of the oil is within the threshold of the predetermined oil temperature.

4. The method of claim 3, wherein the oil cooler bypass valve passively responds to pressure of the oil to adopt the first position, the second position or the third position.

5. The method of claim 3, wherein the oil pump is a variable displacement oil pump.

6. The method of claim 3, wherein controlling the oil pump includes adjusting a position of a solenoid valve of the oil pump based on a command from a controller.

7. The method of claim 6, wherein the oil cooler bypass valve is not communicably coupled to the controller.

8. The method of claim 3, wherein the first pressure is greater than 500 kPa, wherein the second pressure is between 250-400 kPa, and where the third pressure is between 100-200 kPa.

9. The method of claim 3, wherein heat energy is transferred between a coolant circulating through the oil cooler and the oil.

10. The method of claim 3, wherein the first pressure is greater than the second pressure, which is in turn greater than the third pressure.

11. A method comprising: controlling whether an oil used for lubricating an engine is routed through or around an oil cooler solely by adjusting a pressure of the oil emanating from an oil pump, the controlling including each of: biasing an oil cooler bypass valve to a first open valve position under a first operating condition, to a closed valve position under a second operating condition, and to a second open valve position under a third operating condition, wherein the first operating condition includes a cold-start of the engine where pressure of an oil circuit that receives the oil is below a threshold circuit pressure and a temperature of the oil is not within a threshold of a predetermined oil temperature; where the second operating condition includes the oil circuit pressurized to above the threshold circuit pressure and where the temperature of the oil is not within the threshold of the predetermined temperature; and where the third operating condition includes the oil circuit pressurized to above the threshold pressure and the temperature of the oil within the threshold of the predetermined temperature.

12. The method of claim 11, wherein the first operating condition includes a cold-start of the engine where pressure of an oil circuit that receives the oil is below a threshold circuit pressure and a temperature of the oil is not within a threshold of a predetermined oil temperature;

where the second operating condition includes the oil circuit pressurized to above the threshold circuit pressure and where the temperature of the oil is not within the threshold of the predetermined temperature; and where the third operating condition includes the oil circuit pressurized to above the threshold pressure and the temperature of the oil within the threshold of the predetermined temperature.

13. The method of claim 12, wherein biasing the oil cooler bypass valve to the first position allows the oil to bypass the oil cooler, where biasing the oil cooler bypass valve to the closed position prevents the oil from bypassing the oil cooler, and where biasing the oil cooler bypass valve to the second open position allows the oil to bypass the oil cooler.

14. The method of claim 12, wherein the oil cooler additionally receives a coolant from a coolant system; and wherein heat is transferred from the oil to the coolant or vice versa with the oil cooler bypass valve closed under the second operating condition.

15. The method of claim 12, wherein the oil pump is a variable flow oil pump; and wherein the pressure of the oil emanating from the oil pump is adjusted based on a command from a controller to a valve associated with the oil pump.

16. A system for a vehicle, comprising:

a variable flow oil pump that provides an oil to an engine for lubrication purposes by way of an oil circuit;

an oil cooler;

an oil cooler bypass valve; and a controller with computer readable instructions stored on non-transitory memory that when executed, cause the controller to:

determine an operating condition of the engine; and command the variable flow oil pump to pump the oil at a determined pressure that includes each of a first pressure, a second pressure and a third pressure as a function of the operating condition of the engine, where the determined pressure passively adjusts a valve position of the oil cooler bypass valve so as to prevent or enable the oil to bypass the oil cooler, including biasing the oil cooler bypass valve to a first open valve position at the first pressure, to a closed valve position at the second pressure, and to a second open valve position at the third pressure.

17. The system of claim 16, wherein the oil cooler bypass valve is a three-state valve that adopts the first open valve position when the determined pressure is the first pressure, adopts the closed valve position when the determined pressure is the second pressure, and adopts the second open valve position when the determined pressure is the third pressure, where the first pressure is greater than the second pressure which is in turn greater than the third pressure; and wherein the oil is prevented from bypassing the oil cooler when the oil cooler bypass valve is in the closed valve position, but where oil is allowed to bypass the oil cooler when the oil cooler bypass valve is in the first open valve position and the second open valve position.

18. The system of claim 16, further comprising;

a coolant system that flows a coolant through the oil cooler to allow heat transfer between the oil and the coolant.

19. The system of claim 16, wherein the controller stores further instructions to first command the variable flow oil pump to pump the oil at the first pressure at a cold-start event of the engine until the oil circuit is pressurized to above a predetermined oil circuit pressure, then command the variable flow oil pump to pump the oil at the second pressure to raise a temperature of the oil to within a threshold of a predetermined oil temperature; and responsive to the temperature of the oil being within the threshold of the predetermined oil temperature, command the variable flow oil pump to pump the oil at the third pressure.

20. The system of claim 19, wherein the controller stores further instructions to determine whether the temperature of the oil has reached a threshold oil temperature that is greater than the predetermined oil temperature while the variable flow oil pump is commanded to pump the oil at the third pressure; and command the variable flow oil pump to pump the oil at the second pressure to lower the temperature of the oil to within the threshold of the predetermined oil temperature in response to the temperature of the oil reaching the threshold oil temperature while the variable flow oil pump is commanded to pump the oil at the third pressure.

* * * * *